US011674353B2

(12) United States Patent
Zalluhoglu et al.

(10) Patent No.: US 11,674,353 B2
(45) Date of Patent: Jun. 13, 2023

(54) TRAJECTORY CONTROL FOR DIRECTIONAL DRILLING

(71) Applicant: Halliburton Energy Services, Inc., Houston, TX (US)

(72) Inventors: Umut Zalluhoglu, Humble, TX (US); Robert Darbe, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 365 days.

(21) Appl. No.: 16/778,967

(22) Filed: Jan. 31, 2020

(65) Prior Publication Data

US 2021/0238926 A1 Aug. 5, 2021

(51) Int. Cl.

| | |
|---|---|
| ***E21B 7/06*** | (2006.01) |
| ***E21B 44/02*** | (2006.01) |
| ***E21B 47/0228*** | (2012.01) |
| ***E21B 7/10*** | (2006.01) |

(52) U.S. Cl.

CPC ..... *E21B 7/06* (2013.01); *E21B 7/10* (2013.01); *E21B 44/02* (2013.01); *E21B 47/0228* (2020.05)

(58) Field of Classification Search

CPC ..... E21B 7/04; E21B 7/06; E21B 7/10

See application file for complete search history.

(56) References Cited

U.S. PATENT DOCUMENTS

| | | | | |
|---|---|---|---|---|
| 8,676,558 | B2 | 3/2014 | Pirovolou | |
| 9,404,355 | B2 | 8/2016 | Bayliss | |
| 2005/0268063 | A1* | 12/2005 | Diao | G06F 9/5083 711/170 |
| 2013/0048383 | A1 | 2/2013 | Panchai et al. | |
| 2015/0096805 | A1 | 4/2015 | Kruspe et al. | |
| 2015/0101863 | A1* | 4/2015 | Jeffryes | E21B 47/0228 175/24 |
| 2015/0247397 | A1 | 9/2015 | Samuel | |
| 2018/0187542 | A1 | 7/2018 | Sayed et al. | |
| 2019/0345771 | A1 | 11/2019 | Zalluhoglu et al. | |
| 2020/0011167 | A1 | 1/2020 | Zhao et al. | |

FOREIGN PATENT DOCUMENTS

| | | | | |
|---|---|---|---|---|
| WO | WO-2018144169 | A1 * | 8/2018 | E21B 41/00 |
| WO | WO-2018144170 | A1 * | 8/2018 | E21B 44/00 |
| WO | 2019132929 | A1 | 7/2019 | |

OTHER PUBLICATIONS

Application No. PCT/US2020/016207, International Search Report and Written Opinion, dated Oct. 27, 2020, 12 pages.

* cited by examiner

*Primary Examiner* — Giovanna Wright

(74) *Attorney, Agent, or Firm* — Kilpatrick Townsend & Stockton LLP

(57) ABSTRACT

A method for controlling a drilling trajectory of a wellbore includes computing a position and attitude of a drill bit within a wellbore. The method further includes computing a wellbore trajectory error between (i) the position of the drill bit and a well plan position and (ii) the attitude of the drill bit and a well plan attitude. Further, the method includes determining an inclination set-point change command and an azimuth set-point change command using the wellbore trajectory error. Additionally, the method includes steering the drill bit using the inclination set-point change command and the azimuth set-point change command.

20 Claims, 6 Drawing Sheets

TRAJECTORY CONTROL FOR DIRECTIONAL DRILLING

TECHNICAL FIELD

The present disclosure relates generally to systems and methods for use in a well-drilling environment. More specifically, but not by way of limitation, this disclosure relates to autonomously controlling a wellbore drilling trajectory based on a dynamic well plan.

BACKGROUND

As wellbores are drilled into a formation, a drilling trajectory may stray from a planned trajectory indicated in a well plan. A directional driller may correct for the stray (i.e., a wellbore trajectory error) by downlinking inclination and azimuth set-point changes or set points to a rotary steerable system that steers a drill bit. Depending on a skill of the directional driller, the downlinked inclination and azimuth set-point changes may be inaccurate. Inaccuracies in the inclination and azimuth set-point changes may result in further wellbore trajectory error and oscillatory boreholes. Additionally, reliance on the directional driller to downlink the inclination and azimuth set-point changes may result in a late trajectory change that does not account for additional wellbore trajectory error that occurs while the directional driller is determining the new inclination and azimuth set-point changes.

DETAILED DESCRIPTION

Figure 1:
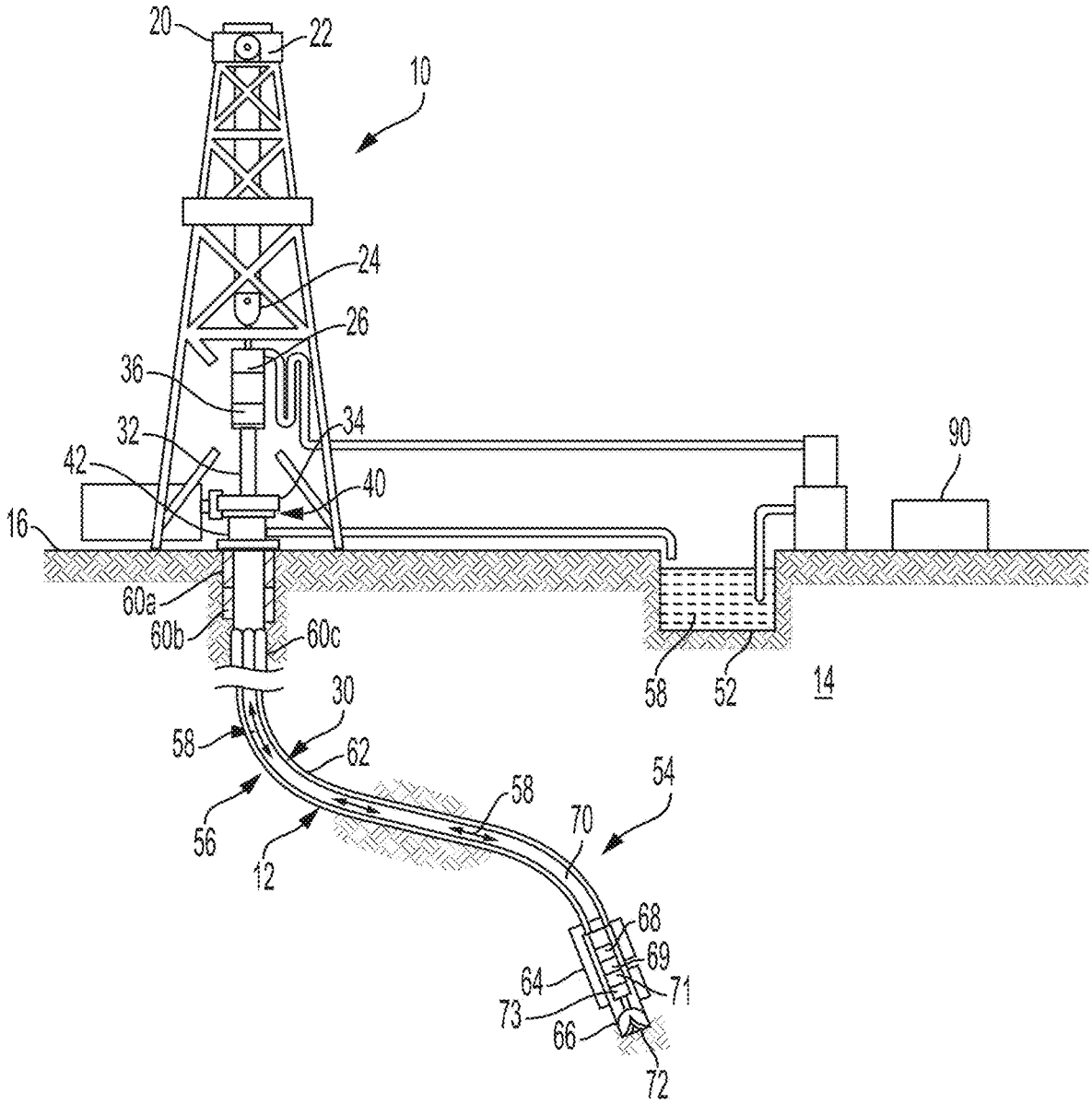
FIG. 1 is a cross-sectional view of an example of a well system incorporating a trajectory control system according to one aspect of the present disclosure.

Certain aspects and features relate to a trajectory control system usable for controlling a rotary steerable system during a wellbore drilling operation. For example, the trajectory control system can receive information from sensors capable of determining a position of the rotary steerable system within the wellbore. Based on the measured position, the trajectory control system can determine a wellbore trajectory error. That is, the trajectory control system can determine a difference between a planned trajectory of the wellbore and the actual trajectory of the wellbore. Using the wellbore trajectory error, the trajectory control system may perform a performance index algorithm to minimize further wellbore trajectory error based on trajectory changes of the rotary steerable system. A performance index of the performance index algorithm may be a function of the wellbore trajectory error in position and an error in attitude of the rotary steerable system, which may include an error in inclination of a drill bit controlled by the rotary steerable system, an error in an azimuth of the drill bit controlled by the rotary steerable system, or a combination thereof. A change to inclination and azimuth of the drill bit that produces the smallest performance index in the performance index algorithm may be provided from the trajectory control system to the rotary steerable system to adjust the trajectory of the drill bit.

Some examples can provide systems and methods usable to control a trajectory of a rotary steerable system during a drilling operation of a wellbore. The wellbore trajectory error in both position and attitude may be calculated every time a survey is taken or periodically with continuous survey feedback from the rotary steerable system (e.g., from any survey tool, such as a measurement-while-drilling (MWD) package). The wellbore trajectory error may be calculated based on a difference between a target trajectory of a well plan and the actual trajectory measured with the surveys. The trajectory control system may use the wellbore trajectory error to determine inclination and azimuth set-point changes of the rotary steerable system that minimize a performance index associated with the wellbore trajectory error. These set-point changes are then used by the rotary steerable system for drilling a wellbore until new set-point changes are determined based on subsequent wellbore trajectory error measurements.

Enabling drilling automation by communicating automated inclination and azimuth set-point changes to the rotary steerable system may reduce error associated with input from directional drillers. The inclination and azimuth set-point changes may be communicated to the rotary steerable system that uses cruise controllers (e.g., attitude-hold controllers, inclination-hold controllers, or azimuth-hold controllers that hold) to hold the target inclination angle, azimuth angle, or both. Additionally, the inclination and azimuth set-point changes may be independently calculated with parallel controllers to control the trajectory in vertical and lateral planes that are perpendicular to one another.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional view of a well system 10 incorporating a trajectory control system 90 according to some examples of the present disclosure. The well system 10 can include a wellbore 12 extending through various earth strata in an oil and gas formation 14 (e.g., a subterranean formation) located below the well surface 16. The wellbore 12 may be formed of a single bore or multiple bores extending into the formation 14, and disposed in any orientation. The well system 10 can include a derrick or drilling rig 20. The drilling rig 20 may include a hoisting apparatus 22, a travel block 24, and a swivel 26 for raising and lowering casing, drill pipe, coiled tubing, and other types of pipe or tubing strings or other types of conveyance vehicles, such as wireline, slickline, and the like. The wellbore 12 can include a drill string 30 that is a substantially tubular, axially-extending drill string formed of a drill pipe joints coupled together end-to-end.

The drilling rig 20 may include a kelly 32, a rotary table 34, and other equipment associated with rotation or translation of drill string 30 within the wellbore 12. For some applications, the drilling rig 20 may also include a top drive unit 36. The drilling rig 20 may be located proximate to a wellhead 40, as shown in FIG. 1, or spaced apart from the wellhead 40, such as in the case of an offshore arrangement. One or more pressure control devices 42, such as blowout preventers (BOPS) and other well equipment may also be provided at wellhead 40 or elsewhere in the well system 10. Although the well system 10 of FIG. 1 is illustrated as being a land-based drilling system, the well system 10 may be deployed offshore.

A drilling or service fluid source 52 may supply a drilling fluid 58 pumped to the upper end of the drill string 30 and flowed through the drill string 30. The fluid source 52 may supply any fluid utilized in wellbore operations, including drilling fluid, drill-in fluid, acidizing fluid, liquid water, steam, or some other type of fluid.

The well system 10 may have a pipe system 56. For purposes of this disclosure, the pipe system 56 may include casing, risers, tubing, drill strings, subs, heads or any other pipes, tubes or equipment that attaches to the foregoing, such as the drill string 30, as well as the wellbore and laterals in which the pipes, casing, and strings may be deployed. In this regard, the pipe system 56 may include one or more casing strings 60 cemented in the wellbore 12, such as the surface 60*a*, intermediate 60*b*, and other casing strings 60*c* shown in FIG. 1. An annulus 62 is formed between the walls of sets of adjacent tubular components, such as concentric and non-concentric casing strings 60 or the exterior of drill string 30 and the inside wall of the wellbore 12 or the casing string 60*c*.

Where the subsurface equipment 54 is used for drilling and the conveyance vehicle is a drill string 30, the lower end of the drill string 30 may include a bottom hole assembly 64, which may carry at a distal end a drill bit 66. During drilling operations, a weight-on-bit is applied as the drill bit 66 is rotated, thereby enabling the drill bit 66 to engage the formation 14 and drill the wellbore 12 along a predetermined path toward a target zone. In general, the drill bit 66 may be rotated with the drill string 30 from the drilling rig 20 with the top drive unit 36 or the rotary table 34, or with a downhole mud motor 68 within the bottom hole assembly 64.

The bottom hole assembly 64 or the drill string 30 may include various other tools, including a power source 69, a rotary steerable system 71, and measurement equipment 73, such as measurement while drilling (MWD) or logging while drilling (LWD) instruments, sensors, circuits, or other equipment to provide information about the wellbore 12 or the formation 14, such as positioning, logging, or measurement data from the wellbore 12.

Measurement data and other information from the tools may be communicated using electrical signals, acoustic signals, or other telemetry that can be received at the well surface 16 to, among other things, monitor the performance of the drill string 30, the bottom hole assembly 64, and the associated drill bit 66, as well as monitor the conditions of the environment to which the bottom hole assembly 64 is subjected (e.g., drilling fluid 58 flow rate).

The drilling fluid 58 may be pumped to the upper end of drill string 30 and flow through a longitudinal interior 70 of the drill string 30, through the bottom hole assembly 64, and exit from nozzles formed in the drill bit 66. At the bottom end 72 of the wellbore 12, the drilling fluid 58 may mix with formation cuttings, formation fluids (e.g., fluids containing gasses and hydrocarbons) and other downhole fluids and debris. The drilling fluid mixture may then flow upwardly through an annulus 62 to return formation cuttings and other downhole debris to the well surface 16.

After drilling through a portion of the formation 14 or while drilling through the formation 14, the measurement equipment 73 can provide survey feedback to the trajectory control system 90. In some examples, the trajectory control system 90 can analyze the survey feedback from the measurement equipment 73 to determine a position (i.e., a true vertical depth and a lateral distance) and attitude (i.e., an inclination and an azimuth) of the drill bit 66 within the wellbore 12. The trajectory control system 90 can compare the position and attitude of the drill bit 66 to well plan mappings in a database to determine a wellbore trajectory error. In an example, the wellbore trajectory error represents a difference between the actual trajectory of the wellbore 12 and the trajectory of the wellbore 12 anticipated in the well plan.

Based on the wellbore trajectory error, the trajectory control system 90 may provide inclination and azimuth set-point changes to the rotary steerable system 71. The inclination and azimuth set-point changes may provide an indication of a new desired trajectory of the drill bit 66 to the rotary steerable system 71 to minimize the wellbore trajectory error. As the drill bit 66 continues to drill the wellbore 12, the trajectory control system 90 may continue to adjust the inclination and azimuth set-point changes based on the survey feedback information from the measurement equipment 73.

Further, while the trajectory control system 90 is depicted as surface equipment, in some examples the trajectory control system 90 may be implemented downhole within the wellbore 12. For example, the trajectory control system 90 may be positioned as part of the bottom hole assembly 64. By installing the trajectory control system 90 at the bottom hole assembly 64, communications lag may be avoided (e.g., from communicating information from the measurement equipment 73 to the surface, and returning communications from the surface to the rotary steerable system 71) such that the inclination and azimuth set-point changes may be implemented in a quicker manner when compared to a surface position of the trajectory control system 90. Additionally, while FIG. 1 depicts the trajectory control system 90 operating in a land-based drilling environment, the trajectory control system 90 may also be implemented in an offshore drilling environment.

Figure 2:
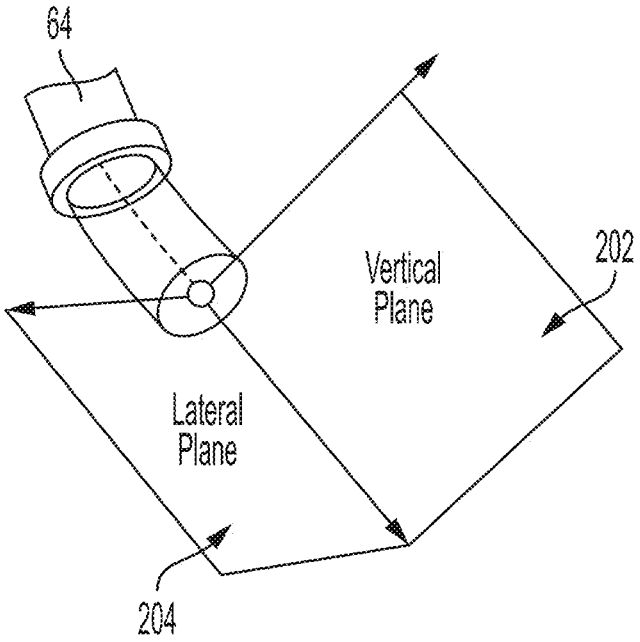
FIG. 2 depicts a vertical and lateral plane of a bottom hole assembly according to one aspect of the present disclosure.

FIG. 2 depicts a vertical plane 202 and lateral plane 204 of a bottom hole assembly according to one aspect of the present disclosure. The inclination set-point change may enable the rotary steerable system 71 of the bottom hole assembly 64 to control the drill bit 66 in the vertical plane 202. Additionally, the azimuth set-point change may enable the rotary steerable system 71 to control the drill bit 66 in the lateral plane 204. By combining the set-point changes to both the azimuth and the inclination, the rotary steerable system 71 is able to control direction of the drilling by the drill bit 66 toward the trajectory indicated by the well plan.

In an example, each time a new survey feedback is received by the trajectory control system 90 (e.g., indicating a new position and attitude of the drill bit 66), a new set of inclination and azimuth set-point changes are generated and provided to the rotary steerable system 71. The new survey feedback may be generated by the measurement equipment 73 during a stationary period of the drill bit 66 (e.g., while new sections of tubing are added to the drill string 30). In another example, the new survey feedback may be provided to the trajectory control system 90 periodically when the measurement equipment 73 provides continuous survey feedback during the drilling operations.

Figure 3:
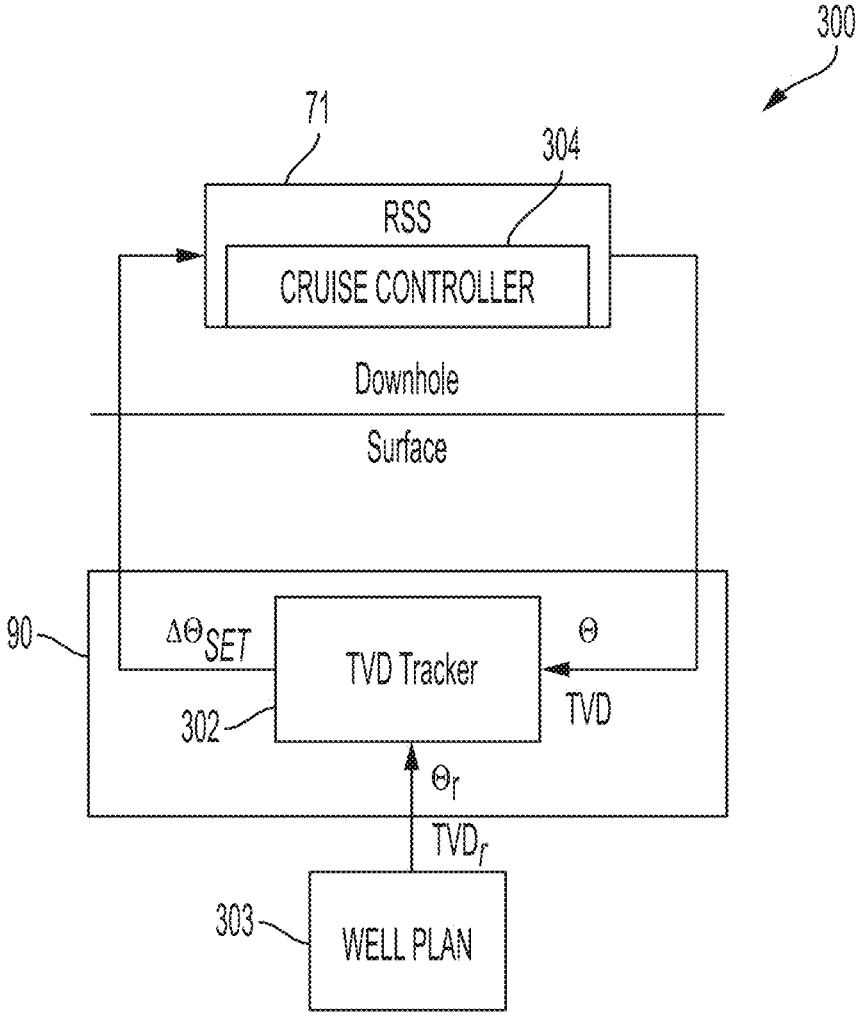
FIG. 3 depicts a block diagram of vertical plan control of a rotary steerable system according to one aspect of the present disclosure.

FIG. 3 depicts a block diagram 300 of vertical plane control of the rotary steerable system 71 according to one aspect of the present disclosure. In the vertical plane 202, the position of the drill bit 66 may be defined by a true vertical depth (TVD). The TVD may be computed as a function of inclination measurements at every stationary survey depth (or periodic survey depth).

A TVD tracker 302 of the trajectory control system 90 may receive a reference TVD (i.e., TVDr) and a reference inclination angle (i.e., Or) from a well plan 303. Additionally, the TVD tracker 302 may receive a measured TVD and a measured inclination angle Θ from a cruise controller 304 (e.g., an inclination-hold controller) of the rotary steerable system 71. The reference inclination angle and the measured inclination angle may be relative to a direction of gravity. By comparing the reference TVD with the measured TVD and the reference inclination angle with the measured inclination angle, the TVD tracker 302 may output an inclination set-point change (i.e., AOSET) to the cruise controller 304 of the rotary steerable system 71. The cruise controller 304 uses the inclination set-point change to control an inclination angle of the rotary steerable system 71 until a subsequent inclination set-point change is received.

In an example, the inclination set-point change may be an indication of a change to the inclination angle at which the cruise controller 304 is currently operating. For example, if the cruise controller 304 is operating at 0.785 radians (i.e., 45 degrees), and the inclination set-point change received by the cruise controller 304 is 0.01 radians, then the cruise controller 304 may adjust the inclination angle to 0.795 radians. Similarly, if the inclination set-point change received by the cruise controller 304 is −0.01 radians, then the cruise controller 304 may adjust the inclination angle to 0.775 radians.

To illustrate this control process mathematically, a discrete depth domain representation of inclination Θ (e.g., in radians) is controlled with an input u (e.g., the inclination set-point change also in radians). The controlled input u is considered to be a change of inclination. That is, u is equal to ΔΘ. Dynamics may be modeled with the assumption that u(k) at step k directly influences Θ(k+1) at step k+1. Then propagation of Θ from step k to step k+1 can be written as:

$$\Theta(k+1)=\Theta(k)+u(k),\Theta(0)=\Theta_0 \quad \text{(Equation 1)}$$

given an inclination $\Theta_0$ at k=0. Rather than the absolute value of Θ, an error of inclination with respect to a reference inclination $\Theta_r$ (e.g., from the well plan 303) is of interest. Accordingly, the system can be represented in terms of inclination error as:

$$\varepsilon_\Theta(k+1)=\varepsilon_\Theta k)+u(k),\varepsilon_\Theta(0)=\varepsilon_{\Theta_0}=\Theta_0-\Theta_{r_0} \quad \text{(Equation 2)}$$

where $\varepsilon_\Theta(k)$ is equal to $\Theta(k)-\Theta_r(k)$ and given a reference inclination $\Theta_{r_0}$ at k=0. Similarly, a derivation of the propagation of true vertical depth, T, from step k to step k+1 is as follows:

$$T(k+1)=T(k)+\frac{\xi}{2}[\cos\Theta(k)+\cos\Theta(k+1)],\ T(0)=T_0 \quad \text{(Equation 3)}$$

where ξ represents a propagation distance (i.e., in feet) and $T_0$ represents an initial reference TVD. ξ may be considered to be a survey-to-survey distance traversed by the drill bit 66. An error between the actual TVD and the reference TVD may be written as:

$$\varepsilon_T(k+1)=\varepsilon_T(k)+\frac{\xi}{2}[\cos\Theta(k)-\cos\Theta_r(k)+\cos\Theta(k+1)-\cos\Theta_r(k+1)],\quad \varepsilon_T(0)=\varepsilon_{T_0}=T_0-T_{r_0} \quad \text{(Equation 4)}$$

where $\varepsilon_T$ (k) is equal to $T(k)-T_r(k)$ and $T_{r_0}$ is the reference TVD at k=0.

A position deviation of the drill bit 66 from the well plan may be indicated as follows:

$$\Delta(k)=-\varepsilon_T(k)=T_r(k)-T(k) \quad \text{(Equation 5)}$$

A position deviation greater than zero may indicate that at step k the drill bit 66 is projected above a position indicated in the well plan 303 in the vertical plane. Accordingly, a further representation of the position deviation is as follows:

$$\Delta(k+1)=\Delta(k)+\frac{\xi}{2}[\cos\Theta(k)-\cos\Theta_r(k)+\cos\Theta(k+1)-\cos\Theta_r(k+1)],\quad \Delta(0)=\Delta_0=T_{r_0}-T_0 \quad \text{(Equation 6)}$$

As $\varepsilon_\Theta$ approaches 0, the following two-step approximation may be made:

$$\cos\Theta_r-\cos\Theta\approx\sin(\Theta-\Theta_r)\approx\Theta-\Theta_r \quad \text{(Equation 7)}$$

This approximation enables linearization of a model as long as Θ is in the vicinity of $\Theta_r$. Thus, the propagation of Δ from step k to step k+1 can be written as follows:

$$\Delta(k+1)=\Delta(k)+\frac{\xi}{2}[\varepsilon_\Theta(k)+\varepsilon_\Theta(k+1)],\ \Delta(0)=\Delta_0 \quad \text{(Equation 8)}$$

Substituting Equation 2 into Equation 8 provides:

$$\Delta(k+1)=\Delta(k)+\xi\varepsilon_\Theta(k)+\frac{\xi}{2}u(k),\ \Delta(0)=\Delta_0 \quad \text{[Equation 9]}$$

Combining Equations 2 and 9 and selecting inclination deviation and position deviation as the states, $x(k)=[\varepsilon_\Theta(k)\ \Delta(k)]^T$, a simplified discrete borehole propagation can be represented in state-space form as:

$$x(k+1)=Ax(k)+Bu(k),\ x_0(k)=\begin{bmatrix}\Theta_0-\Theta_{r_0}\\ T_{r_0}-T_0\end{bmatrix} \quad \text{(Equation 10)}$$

where $A\in\Re^{2\times2}$ and $B\in\Re^{2\times1}$ are as follows:

$$A=\begin{bmatrix}1 & 0\\ \xi & 1\end{bmatrix},\ B=\begin{bmatrix}1\\ \frac{\xi}{2}\end{bmatrix} \quad \text{(Equation 11)}$$

Equation 10 may represent the state of the system by providing an indication of both an error in inclination and an error in TVD. Further, a step size in the model represented by Equation 10 is a survey-to-survey distance $\xi$.

A control strategy may be implemented that corresponds with Equations 1-11 and FIG. 3. A feed-back law is represented as follows:

$$u(k) = -K\begin{bmatrix} \varepsilon_\Theta(k) \\ \Delta(k) \end{bmatrix} \quad \text{(Equation 12)}$$

where $K=[k_1\ k_2]\in \Re^{2+}$ is the control gain vector that relies on tuning to meet desired TVD tracking performance. A performance index J is defined as follows:

$$J = \sum_{k=0}^{\infty}\left(x^T(k)\begin{bmatrix} w_{\varepsilon_\Theta} & 0 \\ 0 & w_\Delta \end{bmatrix}x(k) + u^T(k)w_u u(k)\right) \quad \text{(Equation 13)}$$

where $w_{\varepsilon_\Theta}$, $w_\Delta$, and $w_u\in \Re^{+}$ are weights assigned to penalties on inclination deviation, position deviation, and control input, respectively.

Dynamics represented by Equation 10 fall into a discrete-time linear system class. For this class, an optimal control input in Equation 12 may be computed using an infinite-horizon, discrete-time linear-quadratic regulator (LQR) approach. The optimal value of K that minimizes the performance index J in Equation 13 is given as follows:

$$K=(R+B^TP)^{-1}B^TPA \quad \text{(Equation 14)}$$

where P is a unique positive definite solution to the following discrete algebraic Riccati equation:

$$P=A^TPA-A^TPB(R+B^TPB)^{-1}B^TPA+Q \quad \text{(Equation 15)}$$

where R and Q are weights assignable to the Riccati equation.

For conditions where the survey-to-survey distance $\xi$ is smaller than a response depth $\xi_R$ of the dynamics, the resultant response depth may be expressed as a function of multiple factors:

$$\xi_R=\xi_S+\xi_T+\xi_C \quad \text{(Equation 16)}$$

where $\xi_S$ is a spatial delay caused by distance between survey measurement package placement and the drill bit 66, $\xi_T$ is a telemetry delay that represents a total depth drilled between when a control command u(k) is generated and when it is received by the cruise controller 304 of the rotary steerable system 71, and $\xi_C$ is a response depth of the cruise controlled closed-loop borehole propagation dynamics. In some instances, $\xi_R$ is greater than $\xi$. Considering the step size $\tau_s$ is selected to equal the survey-to-survey distance $\xi$, the system may violate the assumption that u(k) at step k directly influences $\Theta$(k+1) at step k+1. Accordingly, an alternative controller design may be used in instances where $\xi_R$ is greater than $\xi$.

In view of this, Equation 10 may be extended to account for a dynamic response of inclination deviation $\varepsilon_\Theta$(k) to the control command u(k) provided to the cruise controller 304. To capture the transient dynamics of the cruise controlled system, a smaller step size is selected such that $\tau_s$ is much smaller than $\tau_c$. The system equations may be rewritten as follows:

$$\varepsilon_\Theta(k+1) = \varepsilon_\Theta(k) + e^{\frac{-\tau s}{\tau c}}\Delta\varepsilon_\Theta(k) + \left(1 - e^{\frac{-\tau s}{\tau c}}\right)u(k) \quad \text{(Equation 17)}$$

-continued $$\Delta\varepsilon_\Theta(k+1) = e^{\frac{-\tau s}{\tau c}}\Delta\varepsilon_\Theta(k) + \left(1 - e^{\frac{-\tau s}{\tau c}}\right)u(k) \quad \text{(Equation 18)}$$

$$\Delta(k+1) = \Delta(k) + \xi\varepsilon_\Theta(k) + \frac{\xi}{2}e^{\frac{-\tau s}{\tau c}}\Delta\varepsilon_\Theta(k) + \frac{\xi}{2}\left(1 - e^{\frac{-\tau s}{\tau c}}\right)u(k) \quad \text{(Equation 19)}$$

where $\varepsilon_\Theta(0)=\varepsilon_{\Theta_0}$, $\Delta\varepsilon_\Theta(0)=\Delta\varepsilon_{\Theta_0}$, and $\Delta(0)=\Delta_0$. Based on the system equations, the state-space representation becomes:

$$x(k+1) = \begin{bmatrix} 1 & e^{\frac{-\tau s}{\tau c}} & 0 \\ 0 & e^{\frac{-\tau s}{\tau c}} & 0 \\ \xi & \frac{\xi}{2}e^{\frac{-\tau s}{\tau c}} & 1 \end{bmatrix}x(k) + \begin{bmatrix} 1 - e^{\frac{-\tau s}{\tau c}} \\ 1 - e^{\frac{-\tau s}{\tau c}} \\ \frac{\xi}{2}\left(1 - e^{\frac{-\tau s}{\tau c}}\right) \end{bmatrix}u(k) \quad \text{(Equation 20)}$$

where $x(k)=[\varepsilon_\Theta(k)\ \Delta E_\Theta(k)\ \Delta(k)]^T$ and $x(0)=[\varepsilon_{\Theta_0}\ \Delta\varepsilon_{\Theta_0}\ \Delta_0]^T$. The state-space representation of Equation 20 captures the behavior of the cruise controlled dynamics, and the resulting delay $\xi_C$. The remaining two delays, $\xi_S$ and $\xi_T$, may be combined into one delay, $\xi_U$, and added to the dynamics as a pure input delay, which results in the following:

$$x(k+1) = A_d x(k) + B_d u\left(k - \frac{\xi_U}{\tau_s}\right) \quad \text{(Eqution 21)}$$

where $A_d\in \Re^{3\times 3}$ and $B_d\in \Re^{3\times 1}$ are as follows:

$$A_d = \begin{bmatrix} 1 & e^{\frac{-\tau s}{\tau c}} & 0 \\ 0 & e^{\frac{-\tau s}{\tau c}} & 0 \\ \xi & \frac{\xi}{2}e^{\frac{-\tau s}{\tau c}} & 1 \end{bmatrix}, B_d = \begin{bmatrix} 1 - e^{\frac{-\tau s}{\tau c}} \\ 1 - e^{\frac{-\tau s}{\tau c}} \\ \frac{\xi}{2}\left(1 - e^{\frac{-\tau s}{\tau c}}\right) \end{bmatrix} \quad \text{(Equation 22)}$$

The input delay in Equation 21 may be absorbed into the system dynamics by adding $$\frac{\xi_U}{\tau_s}$$

poles at z=0, which yields the following:

$$x(k+1)=A_D x(k)+B_D u(k) \quad \text{(Equation 23)}$$

where $$A_D \in \mathbb{R}^{\left(\frac{\xi_U}{\tau_s}+3\right)\times\left(\frac{\xi_U}{\tau_s}+3\right)}$$

and $$B_D \in \mathbb{R}^{\left(\frac{\xi_U}{\tau_s}+3\right)\times 1}$$

are as follows:

$$A_D = \begin{bmatrix} A_d & B_d & 0^{3\times\frac{\xi_U}{\tau_s}} \\ 0^{\left(\frac{\xi_U}{\tau_s}-1\right)\times 3} & 0^{\left(\frac{\xi_U}{\tau_s}-1\right)\times 1} & I_{\left(\frac{\xi_U}{\tau_s}-1\right)} \\ 0^{1\times 3} & 0^{1\times 1} & 0^{\frac{\xi_U}{\tau_s}} \end{bmatrix}, \quad \text{(Equation 24)}$$

-continued $$B_D = \begin{bmatrix} 0^{\left(\frac{\xi_{LT}}{\tau_S}+2\right)\times 1} \\ 1 \end{bmatrix}$$

where $0^{n\times m}$ represents a matrix with n rows and m columns with all elements zero, and $I_n$ is an identity matrix of size n. The feedback control logic of Equations 12-15 can be implemented for the system represented in Equation 23.

Figure 4:
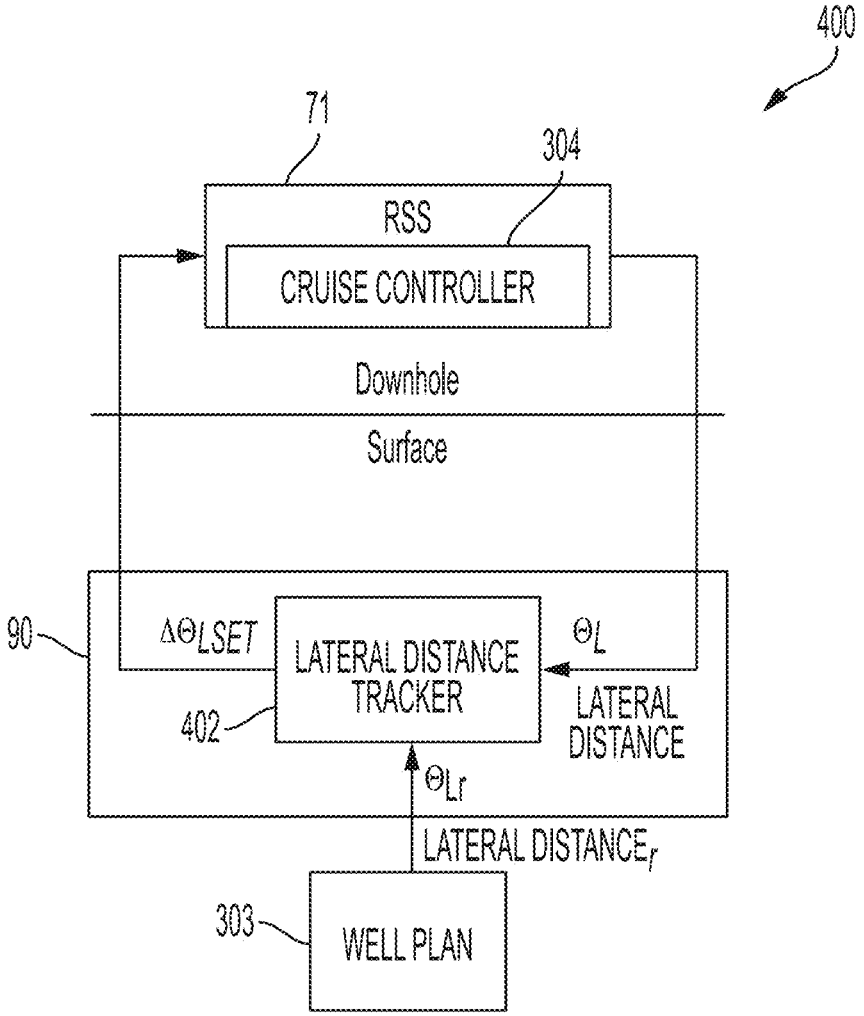
FIG. 4 depicts a block diagram of lateral plane control of the rotary steerable system according to one aspect of the present disclosure.

FIG. 4 depicts a block diagram 400 of lateral plane control of the drill bit 66 by the rotary steerable system 71 according to one aspect of the present disclosure. In the lateral plane 204, the position of the drill bit 66 may be defined by a lateral distance in the lateral plane 204. The lateral distance may be computed as a function of azimuth measurements at every stationary survey depth (or periodic survey depth).

A lateral distance tracker 402 of the trajectory control system 90 may receive a reference lateral distance and a reference azimuth angle (i.e., ΘLr) from the well plan 303. Additionally, the lateral distance tracker 402 may receive a measured lateral distance and a measured azimuth angle ΘL from the cruise controller 304 (e.g., an azimuth-hold controller) of the rotary steerable system 71. The reference azimuth angle and the measured azimuth angle may be relative to true north, or any other predetermined direction along Earth's surface. By comparing the reference lateral distance with the measured lateral distance and the reference azimuth angle with the measured azimuth angle, the lateral distance tracker 402 may output an azimuth set-point change (i.e., ΔθLSET) to the cruise controller 304 of the rotary steerable system 71. The cruise controller 304 may use the azimuth set-point change to control an azimuth angle of the drill bit 66 until a subsequent azimuth set-point change is received.

In an example, the azimuth set-point change may be an indication of a change to the azimuth angle that the cruise controller 304 is currently operating. For example, if the cruise controller 304 is operating at 0.785 radians (i.e., 45 degrees), and the azimuth set-point change received by the cruise controller 304 is 0.01 radians, then the cruise controller 304 will adjust the azimuth angle to 0.795 radians. Similarly, if the azimuth set-point change received by the cruise controller 304 is −0.01 radians, then the cruise controller 304 will adjust the azimuth angle to 0.775 radians.

The determination of the azimuth set-point change provided to the cruise controller 304 may be performed similarly to the inclination set-point change. That is, Equations 1-24 described above may be used with azimuth angles, azimuth set-point changes, and lateral distance in place of inclination angles, inclination set-point changes, and TVD. Further, in some examples, the TVD in the vertical plane 202 is tracked for control of the inclination angle, while the azimuth angle remains stable in the lateral plane 204. In other examples, the lateral distance in the lateral plane 204 is tracked for control of the azimuth angle, while the inclination angle remains stable in the vertical plane 204. Moreover, the both the TVD and the lateral distance may be tracked for control of both the inclination angle and the azimuth angle simultaneously.

The cruise controller 304 may be extended to a stochastic controller in some examples. That is, the cruise controller 304 may be designed to control a stochastic system where the behavior of the cruise controller 304 results from the imperfect tracking of inclination angles, azimuth angles, or both. This imperfect tracking may be modeled as a process noise. In such an example, a linear-quadratic-Gaussian (LQG) control approach, which is an extension of the linear-quadratic regulator (LQR) approach of Equations 1-24, can be used. Similarly, other optimal control approaches can be used in place of infinite-horizon LQR, such as finite-horizon LQR or Model Predictive Control when operational or control constraints are added to the optimal control framework.

While the trajectory control system 90 is depicted in FIGS. 1, 3, and 4 as being located at the surface of the wellbore 12, the trajectory control system 90 may also be positioned downhole within the wellbore 12. In such an example, the trajectory control system 90 may be positioned at or near the rotary steerable system 71. Surveys may be taken with fixed intervals so that the wellbore position can be calculated without depth information downhole. The trajectory plan of the wellbore 12 (e.g., from the well plan 303) may be embedded in the memory of the rotary steerable system 71 so that position error can be computed downhole. Additionally, a position correction may be downlinked periodically (e.g., every few surveys) from the surface to correct for any error accumulation occurring downhole.

Figure 5:
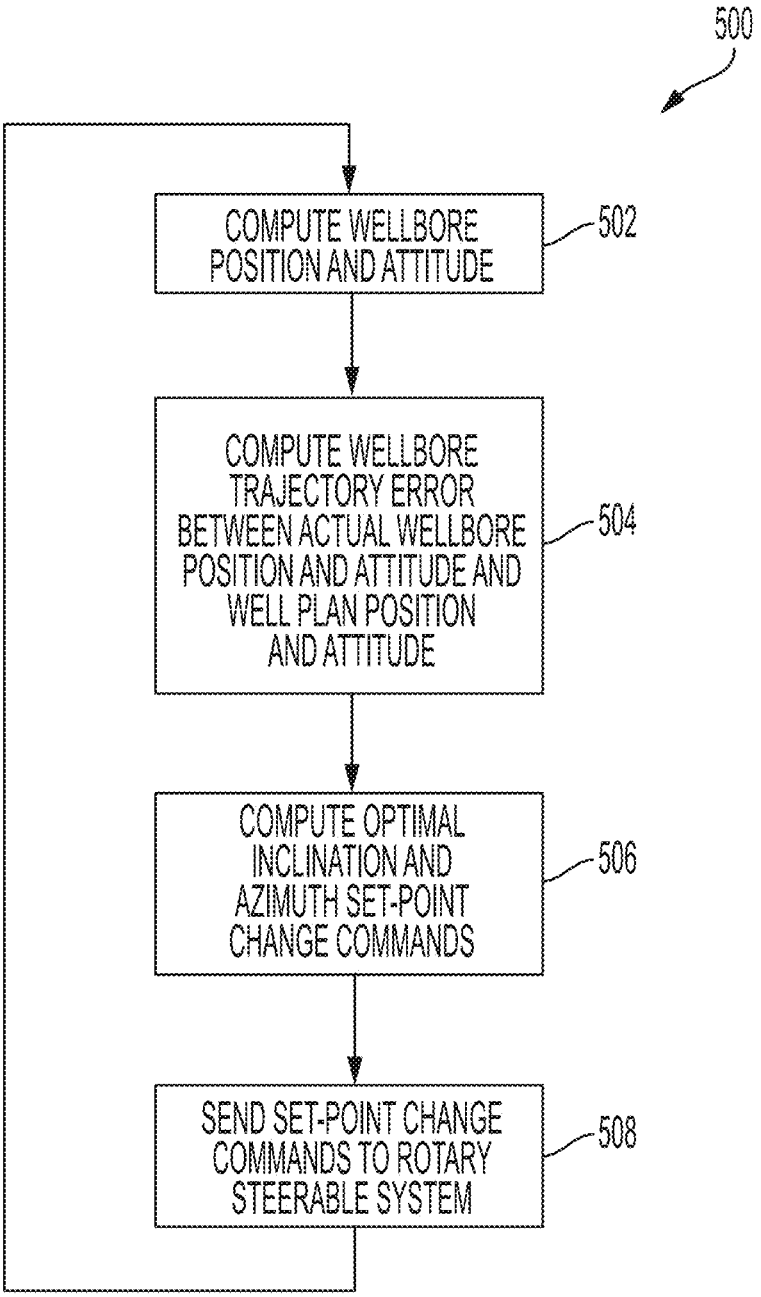
FIG. 5 is a flowchart describing a process for controlling a rotary steerable system according to one aspect of the present disclosure.

FIG. 5 is a flowchart describing a process 500 for controlling the rotary steerable system 71 according to one aspect of the present disclosure. For illustrative purposes, the process 500 is described with reference to certain examples depicted in the figures. Other implementations, however, are possible.

At block 502, the process 500 involves computing wellbore position and attitude. The wellbore position and attitude may be calculated every time a survey is taken by the measurement equipment 73 or periodically with continuous survey feedback (e.g., during the drilling operation) by the measurement equipment 73. The wellbore position may include an indication of true vertical depth and lateral distance of the drill bit 66. The attitude may include an indication of a current inclination angle and a current azimuth angle of the drill bit 66 (i.e., indicating a direction in which the drill bit 66 is drilling).

At block 504, the process 500 involves computing a wellbore trajectory error between a position and attitude of the wellbore 12 and a position and attitude of the well plan 303. The wellbore trajectory error may include a difference between the measured position of the drill bit 66 and the well plan position of the drill bit 66. Additionally, the wellbore trajectory error may include a difference between the measured attitude of the drill bit 66 and the well plan attitude of the drill bit 66.

At block 506, the process 500 involves computing optimal inclination and azimuth set-point change commands. As discussed above with respect to FIGS. 3 and 4, the optimal inclination and azimuth set-point change commands may be determined based on set-point changes that minimize a performance index, as presented in Equations 12 and 13. Set-point changes to the inclination and azimuth that result in minimization of the performance index provide a new trajectory to the drill bit 66 to move the wellbore trajectory more in line with the intended wellbore trajectory indicated in the well plan 303.

In some examples, an advisory mode may be used with the process 500. In such an example, the set-point changes to the inclination and the azimuth may be provided to a directional driller (e.g., an operator controlling the drilling operation) for confirmation that the directional driller would like to implement the set-point changes. In response, the directional driller may choose to implement or to not implement the set-point changes for various reasons.

At block 508, the process 500 involves sending set-point change commands (i.e., indicating new inclination and azimuth set-point changes) to the cruise controller 304 of the rotary steerable system 71. The set-point change commands may stay in effect at the cruise controller 304 until the process 500 is repeated and a new set of set-point change commands are provided to the cruise controller 304 of the rotary steerable system 71.

Figure 6:
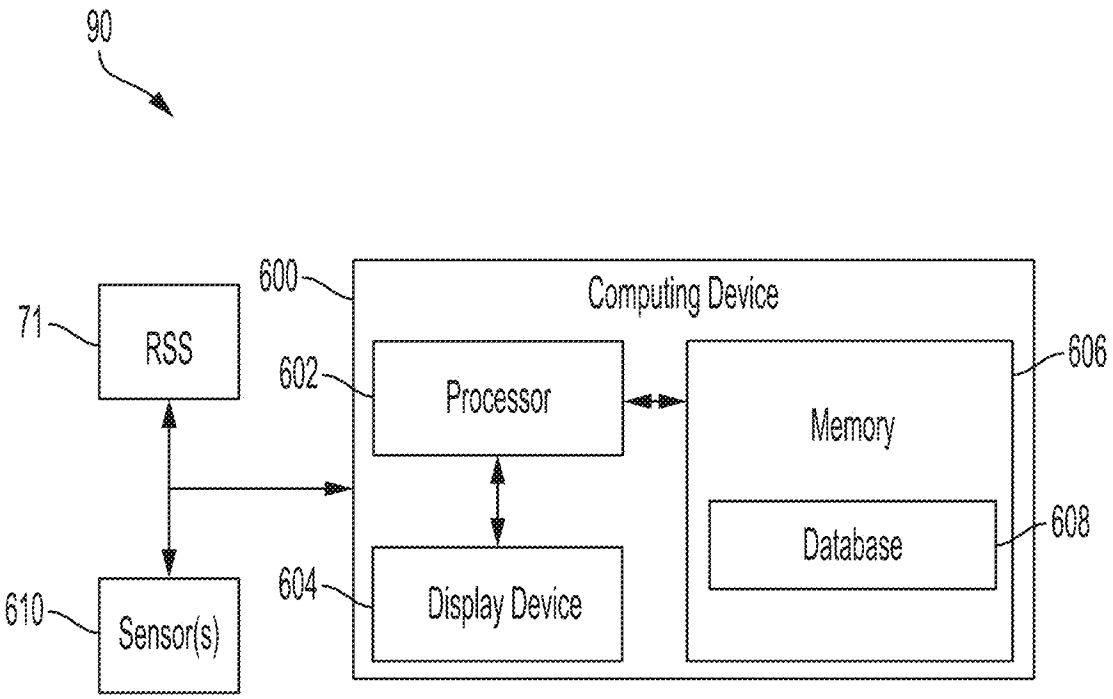
FIG. 6 is a block diagram of an example of a trajectory control system according to one aspect of the present disclosure.

FIG. 6 is a block diagram of the trajectory control system 90 according to some examples of the present disclosure. The trajectory control system 90 can include a computing device 600 having a processor 602, a display device 604, and a memory 606. In some examples, the components shown in FIG. 6 (e.g., the processor 602, the display device 604, and the memory 606) can be integrated into a single structure. For example, the components can be within a single housing. In other examples, the components shown in FIG. 6 can be distributed (e.g., in separate housings) and in electrical communication with each other.

Sensor(s) 610 can be communicatively coupled to the computing device 600 to transmit information about the location of the drill bit 66 within the wellbore 12. Examples of the sensors 610 can include measurement-while-drilling (MWD) sensors useable to measure position and attitude of the drill bit 66. In some examples, the sensors 610 can be integrated on the rotary steerable system (RSS) 71 (e.g., the sensors 610 are within the RSS 71).

The processor 602 can execute one or more operations for implementing some examples. The processor 602 can execute instructions stored in the memory 606 to perform the operations. The processor 602 can include one processing device or multiple processing devices. Non-limiting examples of the processor 602 include a Field-Programmable Gate Array ("FPGA"), an application-specific integrated circuit ("ASIC"), a microprocessor, etc.

The processor 602 can be communicatively coupled to the memory 606 via a bus. The non-volatile memory 606 may include any type of memory device that retains stored information when powered off. Non-limiting examples of the memory 606 include electrically erasable and programmable read-only memory ("EEPROM"), flash memory, or any other type of non-volatile memory. In some examples, at least some of the memory 606 can include a medium from which the processor 602 can read instructions. A computer-readable medium can include electronic, optical, magnetic, or other storage devices capable of providing the processor 602 with computer-readable instructions or other program code. Non-limiting examples of a computer-readable medium include (but are not limited to) magnetic disk(s), memory chip(s), ROM, RAM, an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

The memory 606 can include a database 608, which can include any amount and combination of the content described in previous examples. The database 608 can store 3D mappings of well plans, mathematical equations used for generating wellbore trajectory error, performance index algorithms, or any combination of these, among other things.

The display device 604 can receive display signals from the processor 602 and responsively output any information related to the wellbore trajectory or any other information useable to manage wellbore drilling operations. One example of the display device 604 can include a liquid crystal display. Further, the rotary steerable system 71 can receive inclination and azimuth set-point changes from the processor 602 to provide a new trajectory for the drill bit 66 controlled by the rotary steerable system 71.

In some aspects, systems, devices, and methods for managing wellbore cement compositions based on material characteristics are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a sensor positionable within a wellbore to detect a position and attitude of a drill bit within the wellbore; a rotary steerable system positionable within the wellbore to steer the drill bit; a processing device positionable to communicatively couple to the sensor and the rotary steerable system; and a memory device comprising instructions that are executable by the processing device for causing the processing device to: receive sensor signals from the sensor; compute a wellbore trajectory error between (i) the position of the drill bit and a well plan position and (ii) the attitude of the drill bit and a well plan attitude; determine an inclination set-point change command, an azimuth set-point change command, or both using the wellbore trajectory error; and transmit the inclination set-point change command and the azimuth set-point change command to the rotary steerable system to steer the drill bit.

Example 2 is the system of example 1, wherein the inclination set-point change command and the azimuth set-point change command are determined using the wellbore trajectory error applied to a linear-quadratic regulator (LQR) control approach.

Example 3 is the system of examples 1-2, wherein the inclination set-point change command and the azimuth set-point change command are determined by minimizing a performance index.

Example 4 is the system of examples 1-3, wherein the rotary steerable system maintains an inclination angle and an azimuth angle until a new inclination set-point change command and a new azimuth set-point change command are received at the rotary steerable system.

Example 5 is the system of examples 1-4, wherein determining the inclination set-point change command and the azimuth set-point change command accounts for a response depth comprising a spatial delay, a telemetry delay, a closed-loop borehole propagation dynamics delay, or a combination thereof.

Example 6 is the system of examples 1-5, wherein the position of the drill bit comprises an indication of a true vertical depth and a lateral distance.

Example 7 is the system of examples 1-6, wherein the attitude of the drill bit comprises an indication of an inclination angle and an azimuth angle of the drill bit.

Example 8 is the system of examples 1-7, wherein the inclination set-point change command and the azimuth set-point change command are determined using the wellbore trajectory error applied to a linear-quadratic-Gaussian (LQG) control approach.

Example 9 is a method comprising: computing a position and attitude of a drill bit within a wellbore; computing a wellbore trajectory error between (i) the position of the drill bit and a well plan position and (ii) the attitude of the drill bit and a well plan attitude; determining an inclination set-point change command and an azimuth set-point change command using the wellbore trajectory error; and steering the drill bit using the inclination set-point change command and the azimuth set-point change command.

Example 10 is the method of example 9, wherein the inclination set-point change command and the azimuth set-point change command are determined using the wellbore trajectory error applied to a linear-quadratic regulator (LQR) control approach.

Example 11 is the method of examples 9-10, wherein the inclination set-point change command and the azimuth set-point change command are determined by minimizing a performance index.

Example 12 is the method of examples 9-11, wherein steering the drill bit comprises a rotary steerable system maintaining an inclination angle and an azimuth angle until a new inclination set-point change command and a new azimuth set-point change command are received at the rotary steerable system.

Example 13 is the method of examples 9-12, wherein determining the inclination set-point change command and the azimuth set-point change command accounts for a response depth comprising a spatial delay, a telemetry delay, a closed-loop borehole propagation dynamics delay, or a combination thereof.

Example 14 is the method of examples 9-13, wherein the position of the drill bit comprises an indication of a true vertical depth and a lateral distance.

Example 15 is the method of examples 9-14, wherein the attitude of the drill bit comprises an indication of an inclination angle and an azimuth angle of the drill bit.

Example 16 is a non-transitory computer-readable medium comprising program code that is executable by a processing device for causing the processing device to: receive sensor signals from a sensor; determine a position and attitude of a drill bit within a wellbore using the sensor signals; compute a wellbore trajectory error between (i) the position and a well plan position and (ii) the attitude and a well plan attitude; determine an attitude set-point change command using the wellbore trajectory error; and transmit the attitude set-point change command to a rotary steerable system to steer the drill bit.

Example 17 is the non-transitory computer-readable medium of example 16, wherein the attitude set-point change command comprises an inclination set-point change command, an azimuth set-point change command, or a combination of the inclination set-point change command and the azimuth set-point change command.

Example 18 is the non-transitory computer-readable medium of examples 16-17, wherein the attitude set-point change command is determined using the wellbore trajectory error applied to a linear-quadratic regulator (LQR) control approach.

Example 19 is the non-transitory computer-readable medium of examples 16-18, wherein determining the attitude set-point change command accounts for a response depth comprising a spatial delay, a telemetry delay, a closed-loop borehole propagation dynamics delay, or a combination thereof.

Example 20 is the non-transitory computer-readable medium of examples 16-19, wherein the position of the drill bit comprises an indication of a true vertical depth and a lateral distance, and wherein the attitude of the drill bit comprises an indication of an inclination angle and an azimuth angle.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a sensor positionable within a wellbore to detect a position and attitude of a drill bit within the wellbore; a rotary steerable system positionable within the wellbore to steer the drill bit; a processing device positionable to communicatively couple to the sensor and the rotary steerable system; and a memory device of the rotary steerable system, comprising instructions that are executable by the processing device for causing the processing device to: store a wellbore plan; receive sensor signals from the sensor; compute a wellbore trajectory error, while the rotary steerable system is downhole within the wellbore, between (i) the position of the drill bit and a well plan position of the wellbore plan and (ii) the attitude of the drill bit and a well plan attitude of the wellbore plan; determine an inclination set-point change command, an azimuth set-point change command, or both using the wellbore trajectory error to minimize the wellbore trajectory error to adhere to the well plan, wherein determining the inclination set-point change command and the azimuth set-point change command accounts for a response depth comprising a spatial delay and a telemetry delay; and transmit the inclination set-point change command, the azimuth set-point change command, or both, to the rotary steerable system to steer the drill bit.

2. The system of claim 1, wherein the inclination set-point change command and the azimuth set-point change command are determined using the wellbore trajectory error applied to a linear-quadratic regulator (LQR) control approach.

3. The system of claim 1, wherein the inclination set-point change command and the azimuth set-point change command are determined by minimizing a performance index.

4. The system of claim 1, wherein the rotary steerable system maintains an inclination angle and an azimuth angle until a new inclination set-point change command and a new azimuth set-point change command are received at the rotary steerable system.

5. The system of claim 4, wherein the position of the drill bit comprises an indication of a true vertical depth and a lateral distance.

6. The system of claim 4, wherein the attitude of the drill bit comprises an indication of an inclination angle and an azimuth angle of the drill bit.

7. The system of claim 4, wherein the inclination set-point change command and the azimuth set-point change command are determined using the wellbore trajectory error applied to a linear-quadratic-Gaussian (LQG) control approach.

8. The system of claim 4, wherein the spatial delay comprises a closed-loop borehole propagation dynamics delay.

9. A method comprising: storing a wellbore plan in a memory device of a rotary steerable system; computing a position and attitude of a drill bit within a wellbore; computing a wellbore trajectory error, while the rotary steerable system is downhole within the wellbore, between (i) the position of the drill bit and a well plan position and (ii) the attitude of the drill bit and a well plan attitude of the wellbore plan; determining an inclination set-point change command and an azimuth set-point change command using the wellbore trajectory error to minimize the wellbore trajectory error to adhere to the well plan, wherein determining the inclination set-point change command and the azimuth set-point change command accounts for a response depth comprising a spatial delay and a telemetry delay; and steering the drill bit using the inclination set-point change command and the azimuth set-point change command.

10. The method of claim 9, wherein the inclination set-point change command and the azimuth set-point change command are determined using the wellbore trajectory error applied to an infinite horizon, discrete-time linear-quadratic regulator (LQR) control approach.

11. The method of claim 9, wherein the inclination set-point change command and the azimuth set-point change command are determined by minimizing a performance index.

12. The method of claim 9, wherein steering the drill bit comprises a rotary steerable system maintaining an inclination angle and an azimuth angle until a new inclination set-point change command and a new azimuth set-point change command are received at the rotary steerable system.

13. The method of claim 9, wherein the position of the drill bit comprises an indication of a true vertical depth and a lateral distance.

14. The method of claim 9, wherein the attitude of the drill bit comprises an indication of an inclination angle and an azimuth angle of the drill bit.

15. The method of claim 9, wherein the spatial delay comprises a closed-loop borehole propagation dynamics delay.

16. A non-transitory computer-readable medium comprising program code that is executable by a processing device for causing the processing device to:

store a wellbore plan;

receive sensor signals from a sensor;

determine a position and attitude of a drill bit within a wellbore using the sensor signals;

compute a wellbore trajectory error, while a rotary steerable system is downhole within the wellbore, between (i) the position and a well plan position and (ii) the attitude and a well plan attitude of the wellbore plan;

determine an attitude set-point change command using the wellbore trajectory error to minimize the wellbore trajectory error to adhere to the well plan, wherein determining the attitude set-point change command accounts for a response depth comprising a spatial delay and a telemetry delay; and transmit the attitude set-point change command to a rotary steerable system to steer the drill bit.

17. The non-transitory computer-readable medium of claim 16, wherein the attitude set-point change command comprises an inclination set-point change command, an azimuth set-point change command, or a combination of the inclination set-point change command and the azimuth set-point change command.

18. The non-transitory computer-readable medium of claim 16, wherein the attitude set-point change command is determined using the wellbore trajectory error applied to a linear-quadratic regulator (LQR) control approach.

19. The non-transitory computer-readable medium of claim 16, wherein the position of the drill bit comprises an indication of a true vertical depth and a lateral distance, and wherein the attitude of the drill bit comprises an indication of an inclination angle and an azimuth angle.

20. The non-transitory computer-readable medium of claim 16, wherein the spatial delay comprises a closed-loop borehole propagation dynamics delay.

* * * * *